US007297036B1

(12) United States Patent
Weronke et al.

(10) Patent No.: US 7,297,036 B1
(45) Date of Patent: Nov. 20, 2007

(54) CLUTCH RETENTION SYSTEM FOR A MARINE PROPULSION DEVICE

(75) Inventors: Robert B. Weronke, Oshkosh, WI (US); Jeffrey J. Andrews, Fond du Lac, WI (US); John C. Leroux, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/430,642

(22) Filed: May 9, 2006

(51) Int. Cl.
*B63H 20/14* (2006.01)

(52) U.S. Cl. ..... 440/75; 192/21

(58) Field of Classification Search ..... 440/75, 440/76, 78, 83; 192/21, 51
See application file for complete search history.

(56) References Cited

U.S. PATENT DOCUMENTS

| | | | | |
|---|---|---|---|---|
| 3,608,684 A | | 9/1971 | Shimanckas | 192/20 |
| 4,223,773 A | | 9/1980 | Croisant et al. | 192/48.91 |
| 4,302,196 A | | 11/1981 | Blanchard | 440/75 |
| 4,986,774 A | | 1/1991 | Wantz | 440/75 |
| 5,449,306 A | | 9/1995 | Nakayasu et al. | 440/75 |
| 5,520,559 A | * | 5/1996 | Nakayasu et al. | 440/75 |
| 6,062,360 A | * | 5/2000 | Shields | 192/21 |
| 6,112,873 A | | 9/2000 | Prasse et al. | 192/69.83 |
| 6,544,083 B1 | | 4/2003 | Sawyer et al. | 440/75 |
| 6,893,305 B2 | * | 5/2005 | Natsume et al. | 440/75 |
| 6,960,107 B1 | | 11/2005 | Schaub et al. | 440/75 |

* cited by examiner

*Primary Examiner*—Lars A. Olson
(74) *Attorney, Agent, or Firm*—William D. Lanyi

(57) ABSTRACT

In a marine transmission, trailing faces of each of a plurality of gear projections extending axially from a forward gear are provided with a rake angle. This rake angle of each trailing face cooperates with an associated surface of each of a plurality of clutch projections to retain a dog clutch in an axial position relative to the forward gear even during periods when a marine vessel is rapidly decelerating and, as a result, the dog clutch moves into driving relation with the forward gear.

20 Claims, 5 Drawing Sheets

CLUTCH RETENTION SYSTEM FOR A MARINE PROPULSION DEVICE

BACKGROUND OF THE INVENTION

1. Field of the Invention

The present invention is generally related to a transmission mechanism for a marine propulsion device and, more particularly, to a system which retains a clutch mechanism in its proper position when a driven shaft is caused to rotate at a speed greater than its associated driving shaft.

2. Description of the Related Art

Those skilled in the art of marine propulsion devices are familiar with many different techniques and structures used to transfer torque from a driving shaft to a driven, or propeller, shaft.

U.S. Pat. No. 3,608,684, which issued to Shimanckas on Sep. 28, 1971, describes a clutch for a marine propulsion device. The device affords reverse operation by rotation of the driveshaft housing about a vertical axis. It includes a clutch in the lower unit gear case for selectively engaging or disengaging the propeller shaft with the driveshaft. The clutch is responsive to axial movement of the driveshaft caused by moving a control handle accessible to the operator.

U.S. Pat. No. 4,223,773, which issued to Croisant et al. on Sep. 23, 1980, discloses a drive engaging apparatus. A clutch apparatus for a marine drive lower gear case includes a propeller shaft rotatably mounted in a gear case housing. A drive gear for both forward and reverse is positioned in the housing coaxial with the propeller shaft and a clutch member is rotatably fixed on the propeller shaft and movable axially into drive engagement with the drive gear. Clutch engaging elements are provided on opposed portions of the drive gears and the clutch member. Shift means utilizing a positive acting cam means positively move the clutch member into and out of engagement from the drive gears. The shift means also include a releasable latch means to positively maintain the shift means in the engaged position and a preloading means between the shift means and the clutch member to snap the clutch member into engagement.

U.S. Pat. No. 4,302,196, which issued to Blanchard on Nov. 24, 1981, describes a marine propulsion unit including propeller shaft thrust transmitting means. The marine propulsion device includes a driveshaft housing mounted for vertical swinging movement about a horizontal axis relative to a boat, a propeller shaft rotatably mounted in the driveshaft housing and having an axis of rotation, and a propeller carried by the propeller shaft. The marine propulsion device also includes a first bevel gear mounted in the driveshaft housing and in coaxial relation to the propeller shaft, a second bevel gear mounted in the driveshaft housing and in coaxial relation to the propeller shaft, and a clutch mechanism for selectively drivingly connecting the bevel gears to the propeller shaft.

U.S. Pat. No. 4,986,774, which issued to Wantz on Jan. 22, 1991, discloses a desmodromic shift adaptor for a counter-rotating propeller shaft assembly. The adaptor member accommodates use of a desmodromic cam-actuated shifting mechanism. The adaptor member includes a cup, which is adapted to mount the fore one of the forward and reverse gears through a bearing member. The adaptor member further includes an internal passage within which is disposed the movable cam of the shifting mechanism, and an opening is in communication with the passage for allowing connection of the shift shaft to the shifting cam after assembly of the adapter member into the gear case cavity.

U.S. Pat. No. 5,449,306, which issued to Nakayasu et al. on Sep. 12, 1995, describes a shifting mechanism for an outboard drive. It provides reduced coupling shock when the forward gears are engaged by a dual clutch assembly, as well as providing for consistent and quick engagement of the clutch assembly with the gear. The shifting mechanism involves a first gear and a corresponding first clutch, and a second gear and a corresponding second clutch. A plunger carries the first and second clutches which are arranged on the plunger at unequal distances from their respective gears.

U.S. Pat. No. 6,112,873, which issued to Prasse et al. on Sep. 5, 2000, describes an anti-backlash dog type clutch. The clutch is provided for mounting on a rotatable shaft. The drive clutch includes a drive gear having a plurality of gear teeth projecting therefrom. A sleeve is slidably mounted on the shaft for rotational movement therewith. The sleeve includes a plurality of gear engaging recesses therein of arcuate lengths greater than the predetermined arcuate lengths of the gear teeth. The sleeve is movable between a first retracted position and a second engaged position wherein the gear teeth are received within corresponding gear engagement recesses in the sleeve in order to translate rotation of the drive gear to the shaft. A plurality of anti-backlash elements are provided to compensate for the difference in the arcuate lengths of the gear teeth and their corresponding gear engagement recesses in the sleeve.

U.S. Pat. No. 6,544,083, which issued to Sawyer et al. on Apr. 8, 2003, discloses a shift mechanism for a marine propulsion system. The mechanism is provided in which a cam structure comprises a protrusion that is shaped to extend into a channel formed in a cam follower structure. The cam follower structure can be provided with first and second channels that allow the protrusion of the cam to be extended into either channel which accommodates both port and starboard shifting mechanisms. The cam surface formed on the protrusion of the cam moves in contact with a selected cam follower surface formed in the selected one of two alternative channels to cause the cam follower to move axially and to cause a clutch member to engage with either a first or second drive gear.

U.S. Pat. No. 6,960,107, which issued to Schaub et al. on Nov. 1, 2005, discloses a marine transmission with a cone clutch used for direct transfer of torque. A transmission for a marine propulsion system uses a cone clutch in such a way that, when in a forward gear position, torque is transmitted from the input shaft, or driving shaft, to an output shaft, or driven shaft, solely through the cone clutch. When in forward gear position, driving torque between the driving and driven shafts is not transmitted through any gear teeth. When in reverse gear position, torque is transmitted through an assembly of bevel gears.

The patents described above are hereby expressly incorporated by reference in the description of the present invention.

In certain applications, a driven shaft, such as a propeller shaft, can be caused to rotate faster than an associated driving shaft. Under these conditions, it is possible that a dog clutch member can become disengaged from an associated bevel gear member. It would therefore be significantly beneficial if a system could be provided in which the clutch member is positively retained in meshing relation with the associated bevel gear under these circumstances.

SUMMARY OF THE INVENTION

A transmission for a marine propulsion device, made in accordance with a preferred embodiment of the present invention, comprises a propeller shaft supported for rotation about a propeller shaft axis and first and second gears which are disposed for rotation about the propeller shaft axis. A driveshaft is supported for rotation about a driveshaft axis which is generally perpendicular to the propeller shaft axis in a preferred embodiment of the present invention. A drive gear is attached for rotation with the driveshaft. The first and second gears are disposed in meshing relation with the drive gear for rotation in opposite directions from each other about the propeller shaft. A dog clutch is attached for rotation with a propeller shaft about the propeller shaft axis and between the first and second gears. The dog clutch is movable parallel to the propeller shaft axis in a first direction toward the first gear and away from the second gear and in a second direction toward the second gear and away from the first gear. A first plurality of clutch projections extend from the dog clutch in a direction toward the first gear. A second plurality of gear projections extend from the first gear in a direction toward the dog clutch. Each of the first plurality of gear projections has a leading face and a trailing face. The leading face and the trailing face are each disposed at a rake angle which is greater than one degree.

In a preferred embodiment of the present invention, the leading face and the trailing face are each disposed at a right angle which is greater than three degrees and, in a particularly preferred embodiment of the present invention, the leading and trailing faces are each disposed at a rake angle which is generally equal to five degrees.

A second plurality of gear projections extend from the second gear in a direction toward the dog clutch. Each of the second plurality of gear projections has a leading face and a trailing face. The leading face is disposed at a rake angle which is greater than one degree and the trailing face is disposed at a rake angle which is generally equal to zero degrees. In one embodiment of the present invention, the first face and the second face are each disposed at a rake angle which is greater than one degree. The first face of each of the first plurality of clutch projections is disposable in contact relation with the leading face of the associated one of the first plurality of gear projections when the first gear is in driving relation with the dog clutch and the leading face of each of the first plurality of gear projections is providing a driving force against the first face of an associated one of the first plurality of clutch projections in order to cause the dog clutch and the propeller shaft to rotate in synchrony with the first gear. The second face of each of the first plurality of clutch projections is disposable in contact relation with the trailing face of an associated one of the first plurality of gear projections when the dog clutch is in driving relation with the first gear and the second face of each of the first plurality of clutch projections is providing a driving force against the trailing face of an associated one of the first plurality of gear projections to cause the dog clutch and the propeller shaft to rotate in synchrony with the first gear.

In a preferred embodiment of the present invention, the dog clutch is attached to the propeller shaft by a plurality of spline teeth. The first gear can be a forward gear which, when the plurality of teeth projections is engaged in driving relation with the first plurality of clutch projections, a propeller of the marine propulsion system rotates in a direction which exerts a force on an associated marine vessel in a forward direction. The first and second gears can be bevel gears and the drive gear can also be a bevel gear which is in mesh relation with the first and second gears.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
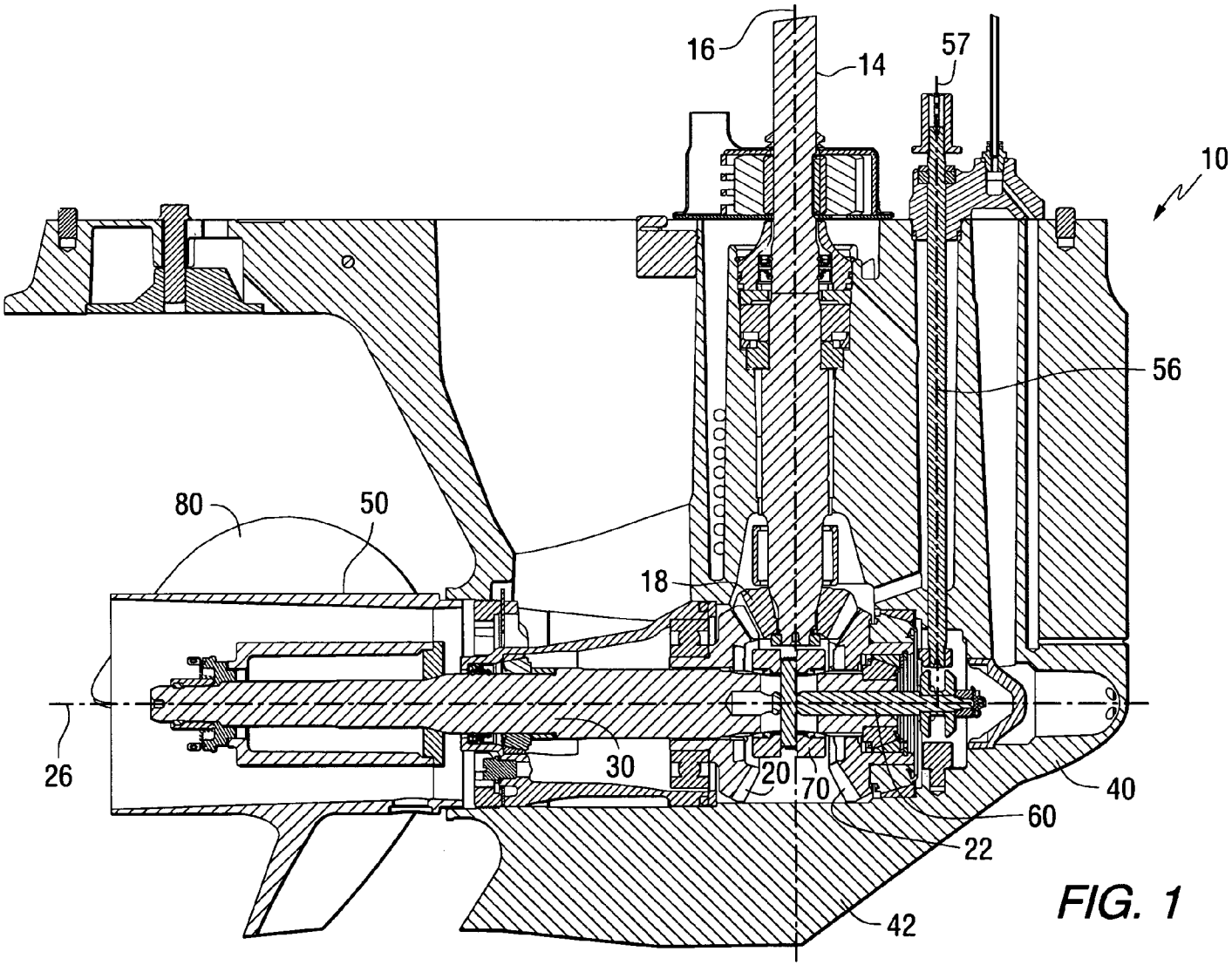
FIG. 1 is a side section view of a marine propulsion device incorporating the present invention.

Throughout the description of the preferred embodiment of the present invention, like components will be identified by like reference numerals.

FIG. 1 is a section view of a marine propulsion device 10 which incorporates a preferred embodiment of the present invention. In a manner which is generally familiar to those skilled in the art, a driveshaft 14 is supported for rotation about a generally vertical axis 16. A lower portion of the driveshaft 14 is attached to a drive gear 18 which is also rotatable about the driveshaft axis 16. First and second gears, 20 and 22, are supported for rotation about a propeller shaft axis 26. A propeller shaft 30 is supported for rotation about the propeller shaft axis 26.

With continued reference to FIG. 1, the components described above are supported within a gear case structure 40. For purposes of general reference, the gear case structure 40 has a skeg 42 extending downwardly from its outer surface. The skeg 42 is partially illustrated in FIG. 1. A propeller structure 50 is shown attached to the propeller shaft 30 for rotation about the propeller shaft axis 26. A shift shaft 56 is supported for rotation about a generally vertical axis and is operatively associated with a horizontally disposed shaft 60 that allows a dog clutch 70 to be moved axially in a direction parallel to the propeller shaft 26 when the shift shaft 56 is rotated about its central axis.

Figure 2:
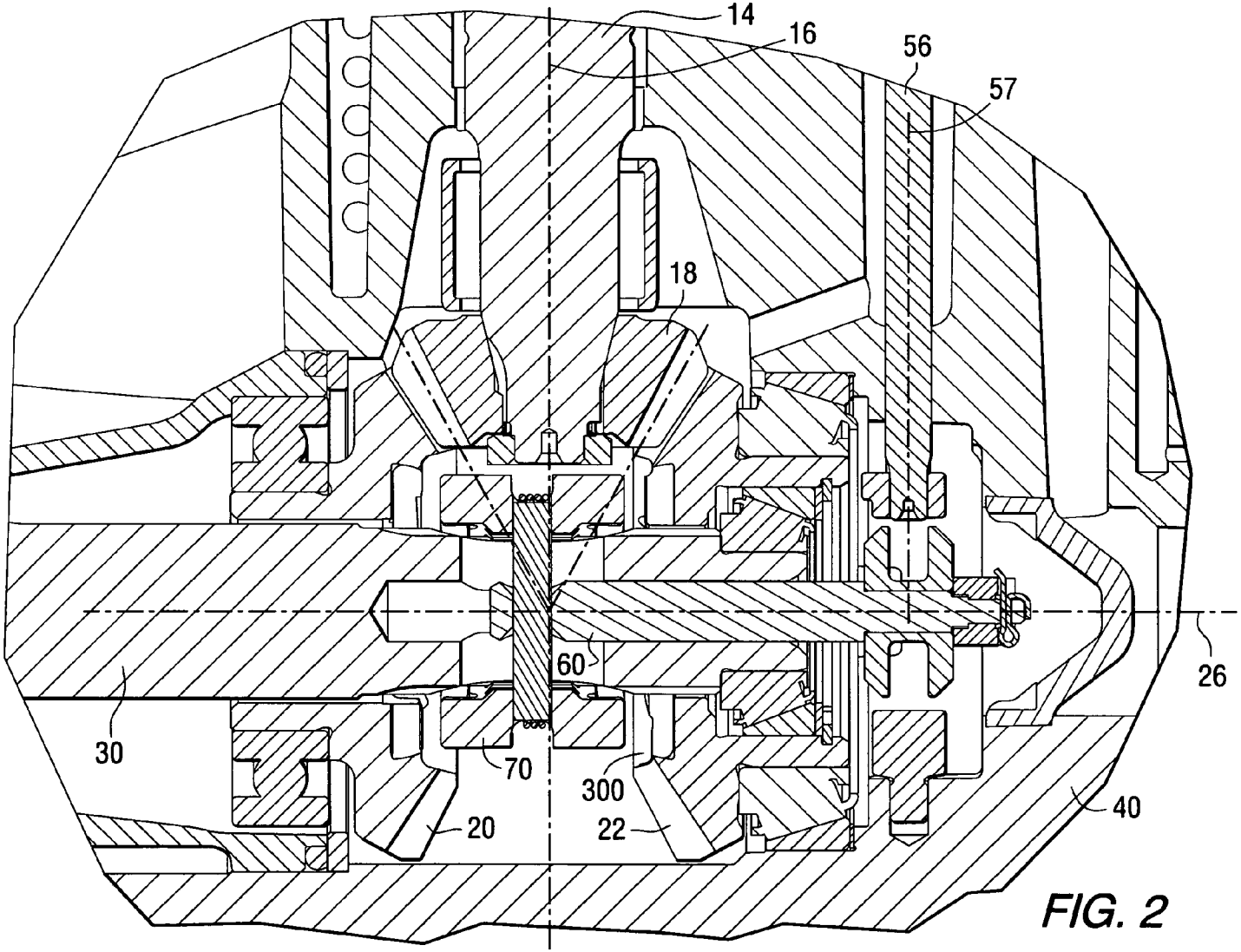
FIG. 2 is an enlarged view of a portion of the illustration of FIG. 1.

FIG. 2 is an enlarged representation of a portion of the structure shown in FIG. 1. With reference to FIGS. 1 and 2, those skilled in the art are familiar with the basic operation of the illustrated structure. When an associated internal combustion engine is operating, the driveshaft 14 continually rotates about its driveshaft axis 16. The drive gear 18 is attached to the bottom portion of the driveshaft 14 and continually rotates with it. The drive gear 18 is in continual meshing relation with teeth of the first and second gears, 20 and 22. The first and second gears are supported for rotation about the propeller shaft axis 26 in a manner that is generally independent of the propeller shaft 30. In other words, the first and second gears, 20 and 22, can rotate about the propeller shaft axis 26 without causing the propeller shaft 30 to rotate. This type of operation occurs when the transmission is in a neutral gear position. Because of the meshing association between the drive gear 14 and the first and second gears, 20 and 22, the first and second gears, 20 and 22, rotate in opposite directions about the propeller shaft axis 26 under all conditions. The dog clutch 70 is movable in a direction which is generally parallel to the propeller shaft axis 26 in response to rotation of the shift shaft 56 about its central axis 57.

With continued reference to FIGS. 1 and 2, it should be understood that the first and second gears, 20 and 22, are typically arranged so that engagement of one of these two gears causes the propeller shaft 30 to rotate in a direction which propels a marine vessel in a forward direction. This one of the first and second gears, 20 or 22, is the forward gear as a result of the rotational direction of the driveshaft 14 about the driveshaft axis 16 and the pitch of the blades 80 of the propeller 50. However, it should be clearly understood that the selection of the forward gear, from the choice of the first and second gears, 20 and 22, is not limiting to the scope of the present invention. In other words, the basic concept of the subject invention can be used to improve the operation of the transmission for a marine propulsion device under either of the two alternative circumstances described above. For purposes of illustrating and describing a preferred embodiment of the present invention, the first gear 20 will be assumed to be the forward gear and the second gear 22 will be assumed to be the reverse gear.

Figure 3:
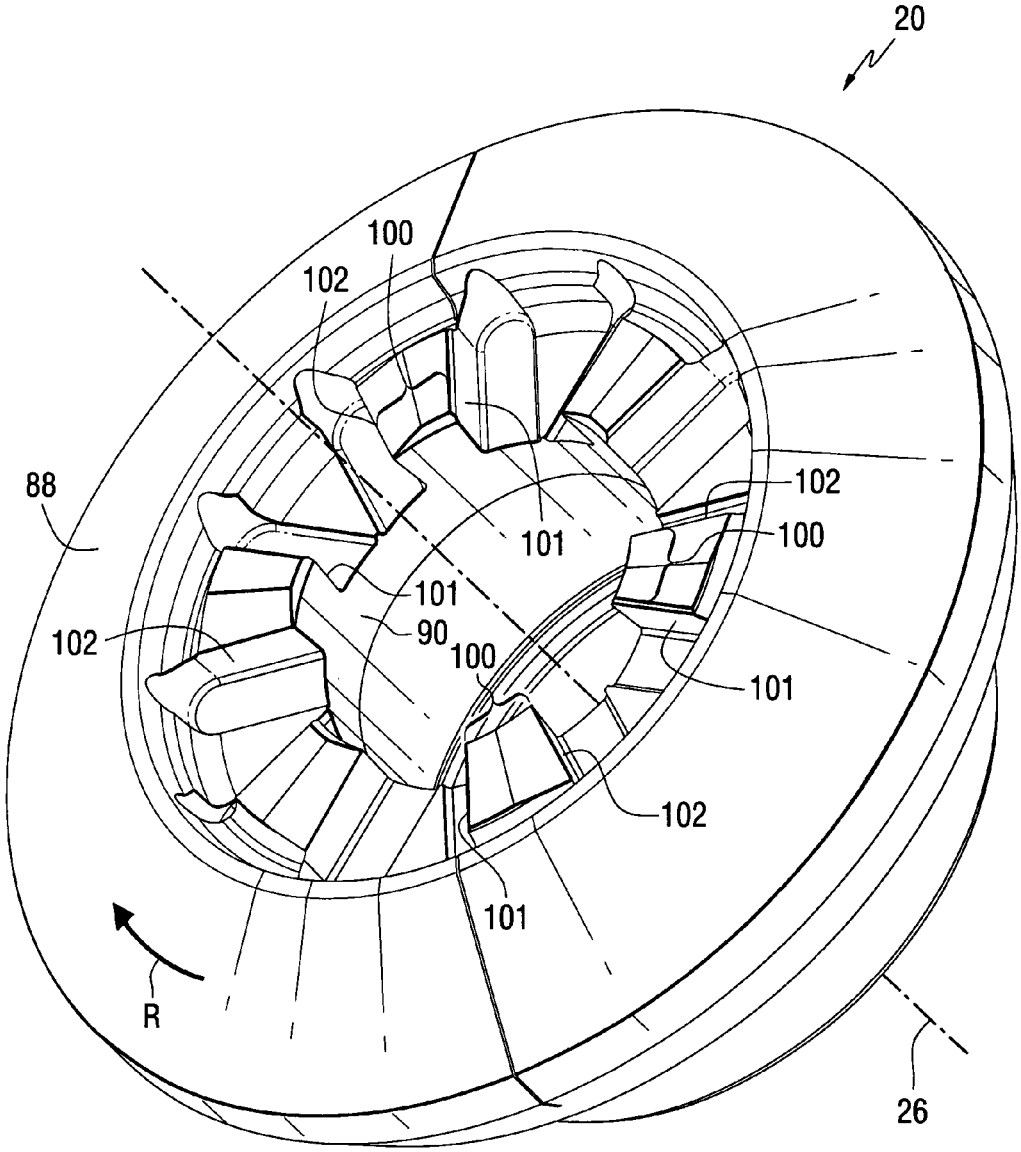
FIG. 3 is an isometric view of a forward gear of a marine propulsion system.

FIG. 3 is an isometric view of the first gear 20. As described above, the first gear shown in FIG. 3 will be assumed to be the forward gear of the marine propulsion system. In FIG. 3, the gear teeth of the bevel gear, located in the region identified by reference numeral 88, are not shown. However, it should be understood that the teeth in this region would be provided, in a manner which is very familiar to those skilled in the art, and configured along the surface of the region 88 which is formed generally in the shape of a frustum of a cone. The first gear 20 shown in FIG. 3 is configured to be rotatable about the propeller shaft axis 26 with its internal cylindrical surface 90 being rotatable about an outer surface of the propeller shaft 30 as illustrated in FIGS. 1 and 2. It should be understood, however, that the internal cylindrical surface 90 is supported in non-contact association with an associated outer surface of the propeller shaft 30. This relationship is maintained so that the rotation of the first gear 20 is independent of the rotation of the propeller shaft 30 unless these two components are linked together by the dog clutch 70 described above.

With reference to FIGS. 1-3, the first gear 20 will be assumed to rotate in the direction represented by arrow R in FIG. 3. A plurality of gear projections 100 extend from the first gear 20, as shown in FIG. 3, in a direction toward the dog clutch 70. Each of the first plurality of gear projections 100 has a leading face 101 and a trailing face 102.

Figure 4:
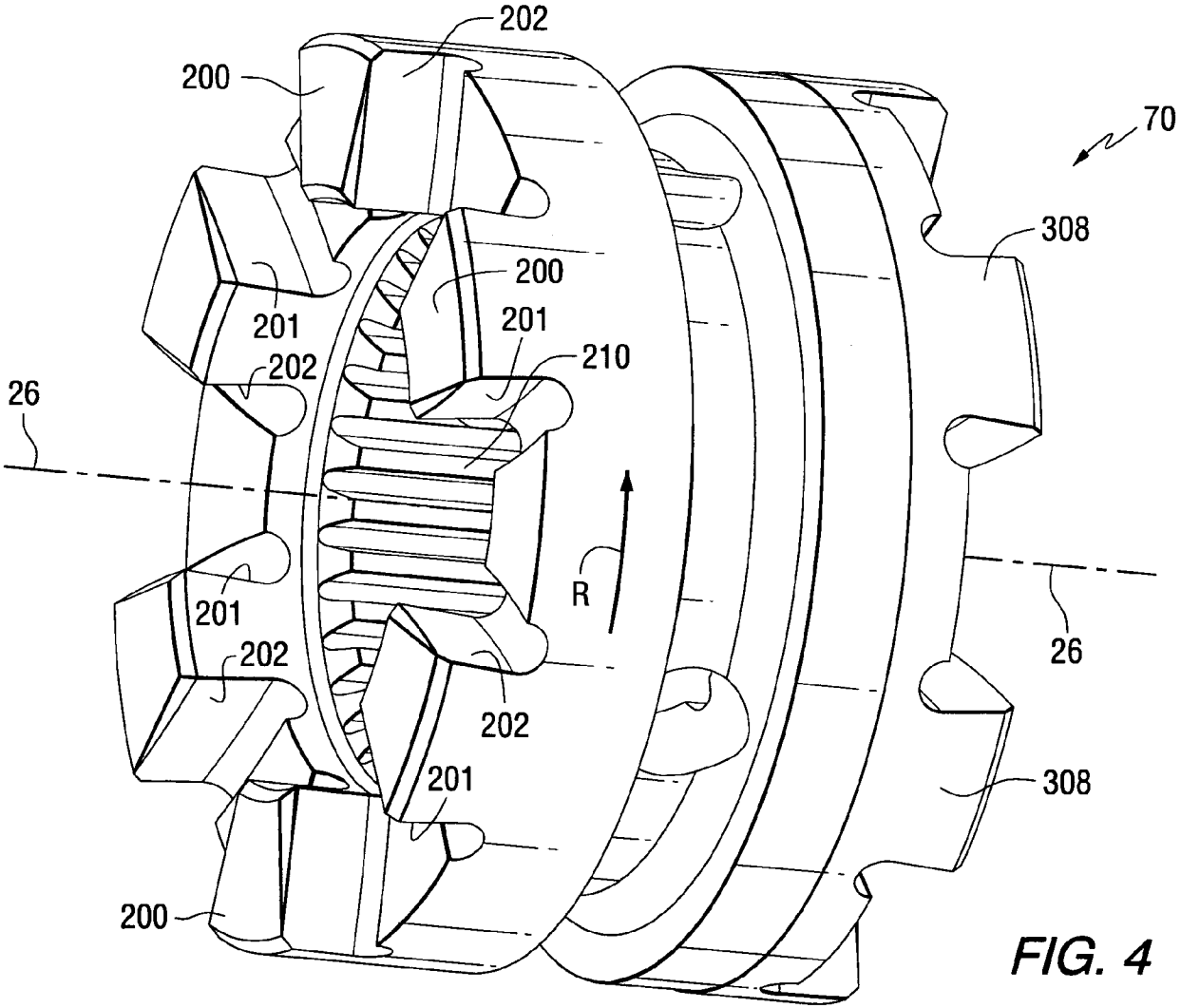
FIG. 4 is an isometric view of a dog clutch of a marine propulsion transmission.

FIG. 4 is an isometric view of the dog clutch 70. As shown, the dog clutch 70 is rotatable about the propeller shaft axis 26. A first plurality of clutch projections 200 extend from the dog clutch 70 in a direction toward the first gear 20. This first plurality of clutch projections 200 is illustrated as extending toward the left in FIG. 4.

With continued reference to FIGS. 3 and 4, those skilled in the art of marine transmissions are familiar with the fact that the dog clutch 70 is attached to the propeller shaft 30, as illustrated in FIGS. 1 and 2, by a plurality of spline teeth. The internal spline teeth of the dog clutch 70 are identified by reference numeral 210 in FIG. 4. This spline arrangement attaches the dog clutch 70 to the propeller shaft 30 for synchronous rotation therewith.

Each of the first plurality of clutch projections 200 has a first face 201 and a second face 202. The first and second faces of each of the first plurality of clutch projections 200 are each disposed at a rake angle which is greater than one degree and, in a particularly preferred embodiment of the present invention, is generally equal to approximately five degrees. As will be described in greater detail below, these rake angles of the first and second faces, 201 and 202, result in the fact that these first and second faces are disposed in individual planes that are not parallel to the propeller axis 26.

With continued reference to FIG. 4, it should be clearly understood that it is well known to those skilled in the art of marine propulsion systems that the first and second faces, 201 and 202, of the dog clutch 70 are configured at rake angles greater than zero degrees. This is done even though the second faces 202 of the plurality of clutch projections 200 is not intended to be placed in direct contact with the plurality of gear projections 100 described above in conjunction with FIG. 3. This provision of rake angles of the second faces 202 of the dog clutch 70 is done as a convenience during the manufacture of the dog clutch. In other words, a milling cutter is typically configured to form adjacent first and second faces, 201 and 202, between adjacent clutch projections during a single pass of the milling cutter in a direction which forms two diametrically opposite gaps between opposite pairs of clutch projections 200 in a single pass. As a result, a second face 202 of each clutch projection 200 is formed with a rake angle greater than zero degrees even though it is not intended that it ever be placed in direct contact with an associated surface of the first gear 20.

With continued reference to FIGS. 3 and 4, it should be understood that when the dog clutch 70 is moved axially in a direction parallel to the propeller shaft axis 26 so that the first plurality of clutch projections 200 is moved into contact with the first plurality of gear projections 100, the leading faces 101 of each of the plurality of gear projections 100 moves into contact with an associated first face 201 of one of the plurality of clutch projections 200. Arrows R in FIGS. 3 and 4 show the resulting rotation of the first gear 20 and the dog clutch 70 in synchrony with each other about the propeller shaft axis 26. This meshing of the plurality of gear projections 100 with the plurality of clutch projections 200 causes the dog clutch 70 to rotate in synchrony with the first gear 20 about the propeller shaft axis 26. The splined connection between the dog clutch 70 and the propeller shaft 30 causes the propeller shaft 30 to rotate about the propeller shaft axis 20. In other words, the engagement of the plurality of clutch projections 200 with the plurality of gear projections 100 result in the transfer of torque from the driveshaft 14 to the propeller shaft 30 in the direction dictated by the rotational direction of the first gear 20 about the propeller shaft axis 26. This basic operation of the components illustrated in FIGS. 1-4 is generally known to those skilled in the art.

With continued reference to FIGS. 1-4, it should be understood that, under certain circumstances, the propeller shaft 30 can be caused to rotate at a speed greater than the first gear 20. Most typically, this circumstance can arise when a rapid deceleration of the driveshaft 14 occurs. In other words, when the operator of a marine vessel rapidly decreases the operating speed of an associated internal combustion engine, the driveshaft 14 decelerates more quickly than the propeller shaft 30. In addition, the movement of the propeller 50 through the water at the speed of the marine vessel causes the blades 80 to exert torque on the propeller shaft 30 to induce its continued rotation at a speed which is greater than the rotational speed of the first gear 20. When this occurs, the leading face 101 of each of the plurality of gear projections 100 can become disengaged from the associated first face 201 of the plurality of clutch projections 200. In marine transmissions known to those skilled in the art, the trailing face 102 of each of the plurality of gear projections 100 is configured to have no rake angle. In other words, the effective rake angle of each of these trailing faces 102 is generally equal to zero. As a result, disengagement between the leading faces 101 of the plurality of gear projections 100 and the first faces 201 of the plurality of clutch projections 200 can allow separation between the dog clutch 70 and the first gear 20 as a result of the tendency of the dog clutch 70 to move axially away from the first gear 20. During these deceleration conditions, the rotational speed of the dog clutch 70 typically exceeds the rotational speed of the propeller shaft 30 because of the hydrodynamic effect of the blades 80 as they move through the water at the speed of the associated marine vessel. This resulting rotational speed of the propeller shaft 30 and the dog clutch 70 is greater than the rotational speed of the first gear 20 which is in meshing contact with the drive gear 18 that is attached to the driveshaft 14. Since the trailing faces 102 of the plurality of gear projections 100 have a rake angle of essentially zero degrees in forward gears known to those skilled in the art, the dog clutch 70 can easily move axially away from the forward gear. This causes disengagement between the plurality of clutch projections 200 and the plurality of gear projections 100 in transmissions known to those skilled in the art.

With continued reference to FIGS. 1-4, the trailing faces 102 of the plurality of gear projections 100, in a first gear made in accordance with a preferred embodiment of the present invention, the surface of each trailing face 102 is provided with a rake angle greater than zero degrees. In a particularly preferred embodiment of the present invention, this rake angle is approximately equal to five degrees. Since the second face 202 of each of the clutch projections 200 is normally provided with a rake angle because of the manufacturing efficiencies described above, the rotation of the dog clutch 70 at speeds greater than the rotation of the first gear 20 will tend to cause the second faces 202 of the clutch projections 200 to move into contact with the trailing faces 102 of the plurality of gear projections 100. Since both the trailing faces 102 and the second faces 202 have a rake angle of approximately five degrees, the dog clutch 70 will be retained in meshing association with the first gear 20 even though the propeller shaft 30 is rotating at a speed greater than the first gear 20 during periods of time when the marine vessel is rapidly decelerating. This retention of the dog clutch 70 in engagement with the first gear 20 provides a significant advantage by preventing the axial movement of the dog clutch 70 away from the first gear 20 when rapid deceleration occurs.

Figure 5B:
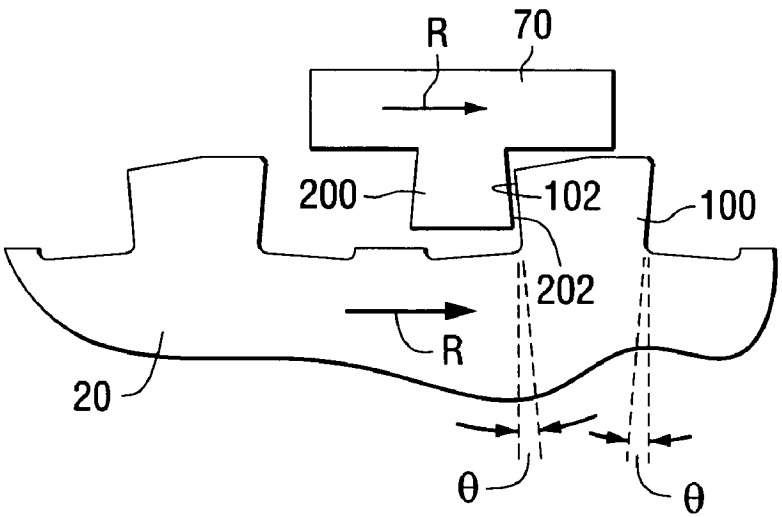
FIG. 5B is generally similar to FIG. 5A but shows the dog clutch in driving relation with a driven forward gear.
Figure 5A:
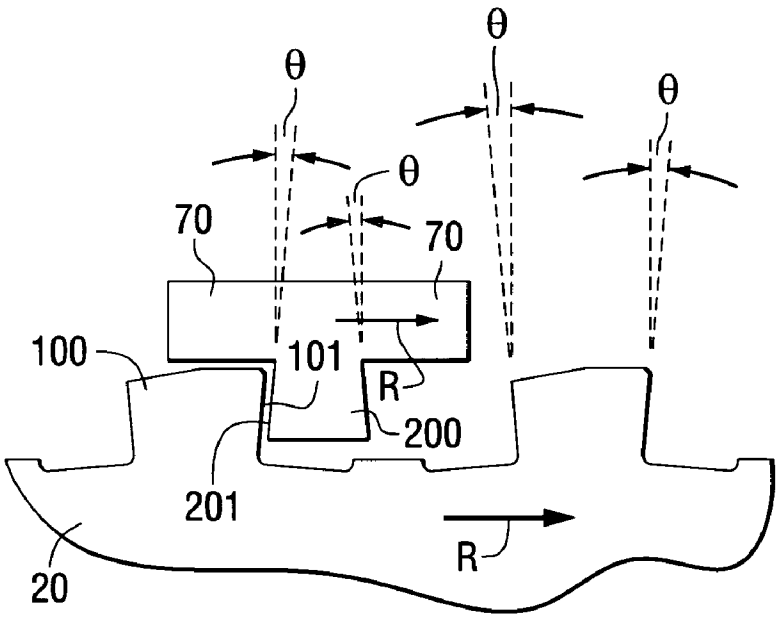
FIG. 5A is a developed view of a plurality of gear projections of a forward gear in association with a clutch projection of a dog clutch when the forward gear is in driving relation with a driven dog clutch.

FIGS. 5A and 5B are developed views which show the relationship between the plurality of gear projections 100 and the plurality of clutch projections 200. Arrows R are provided to show the directions of rotation of the components.

In FIG. 5A, the first gear 20 provides torque, through its connection with the drive gear 18, to the dog clutch 70. This results from the leading face 101 being in direct contact with the first face 201. In a typical arrangement of first gear and dog clutch, both the leading face 101 and the first face 201 are provided with a rake angle θ of approximately five degrees. The rake angles θ of the leading face 101 and first face 201 help to retain the meshing relation between the first gear 20 and the dog clutch 70 when the first gear 20 is driving the dog clutch 70. This relationship is generally known to those skilled in the art.

FIG. 5B shows the relative positions of the plurality of gear projections 100 and plurality of clutch projections 200 when, during periods of rapid deceleration of the marine vessel, the dog clutch 70 is in driving relation with the first gear 20. As described above, this occurs when the hydrodynamic forces on the blades 80 of the propeller 50 cause the propeller shaft 30 to attempt to move at a rotational speed about the propeller axis 26 which is greater than the rotational speed of the first gear 20 about that same axis. As a result, each of the plurality of clutch projections 200 moves into driving relation with an associated one of the plurality of gear projections. This causes the second face 202 of each of these clutch projections 200 to move into contact with a trailing face 102 of the associated gear projection 100. The provision of the rake angle θ, between the trailing face 102 of each of the plurality of gear projections 100 and the second face 202 of each of the plurality of clutch projections 200, maintains the relative axial positions of the dog clutch 70 and first gear 20 even during circumstances when the dog clutch is attempting to rotate faster than the first gear. As a result, the roles of the dog clutch 70 and the first gear 20 are reversed. Rather than a situation when the first gear 20 is driving the dog clutch 70, the dog clutch 70 exerts a driving force on the first gear 20 when the marine vessel is rapidly decelerating and the blades 80 of the propeller 50 are subjected to hydrodynamic forces as described above. This beneficial result is caused by the provision of the rake angle θ of the trailing face 102 of the first gear. As described above, the second face 202, of each of the plurality of clutch projections 200 is normally provided in dog clutches 70 known to those skilled in the art. However, the trailing faces 102 of the plurality of gear projections 100 of the first gear 20 are provided with no such rake angle θ. Instead, these trailing faces 102 are generally parallel to the propeller shaft axis 26.

As a result of the provision of the rake angle θ, of approximately five degrees, of the trailing face 102 on each of the plurality of gear projections 100 of the first gear 20, the dog clutch 70 is retained in its axial position relative to the first gear 20 even during periods of rapid deceleration. The rake angles θ of both the trailing faces 102 and second faces 202, as illustrated in FIG. 5B, result in this beneficial axial retention of the dog clutch 70.

With reference to FIGS. 1-4, 5A and 5B, it can be seen that a preferred embodiment of the present invention provides a transmission for a marine propulsion device that comprises a propeller shaft 30 supported for rotation about a propeller shaft axis 26, a first gear 20 disposed for rotation about the propeller shaft axis 26, a second gear 22 disposed for rotation about the propeller shaft axis 26, a driveshaft 14 supported for rotation about a driveshaft axis 16, a drive gear 18 attached for rotation with the driveshaft 14, a dog clutch 70 attached for rotation with the propeller shaft 30, a first plurality of clutch projections 200 and a first plurality of gear projections 100. The driveshaft axis 16 is generally perpendicular to the propeller shaft axis 26. The first and second gears, 20 and 22, are disposed in meshing relation with the drive gear 18 for rotation in opposite directions from each other about the propeller shaft 30. The dog clutch 70 is attached for rotation with the propeller shaft 30 about the propeller shaft axis 26 and between the first and second gears, 20 and 22. The dog clutch 70 is movable in a direction parallel to the propeller shaft axis 26 in a first direction toward the first gear 20 and away from the second gear 22 and also in a second direction toward the second gear 22 and away from the first gear 20. The first plurality of clutch projections 200 extend from the dog clutch 70 in a direction toward the first gear 20. The first plurality of gear projections 100 extend from the first gear 20 in a direction toward the dog clutch 70. Each of the first plurality of gear projections 100 has a leading face 101 and a trailing face 102. The leading face and the trailing face are each disposed at a rake angle θ which is greater than one degree. In certain embodiments of the present invention, the rake angle θ is greater than three degrees and, in a particularly preferred embodiment of the present invention, the rake angle θ is generally equal to approximately five degrees.

A second plurality of gear projections 300 extend from the second gear 22 in a direction toward the dog clutch 70. Each of the second plurality of gear projections 300 has a leading face and a trailing face. These leading and trailing faces aren't specifically identified by reference numerals in the figures, but are positioned in a manner that is generally similar to the leading and trailing faces of the first plurality of gear projections 100 described above. The second gear 22 provides torque to the propeller shaft 30 that is in a reverse direction than the first gear 20. In other words, the first gear 20 is typically a forward gear and the second gear 22 is typically a reverse gear. The leading face can be disposed at a rake angle θ which is greater than one degree and the trailing face can be disposed at a rake angle θ which is generally equal to zero degrees. In other words, during periods of rapid deceleration, the advantages provided by the rake angle θ on the trailing face 102 of the first plurality of gear projections 100 is not necessary because the problems described above, which can occur during rapid deceleration from movement in a forward direction, typically do not induce axial separation between the dog clutch 70 and the second gear 22.

With continued reference to FIGS. 1-4, 5A and 5B, the first face 201 of each of the first plurality of clutch projections 200, is disposable in contact relation with the leading face 101 of an associated one of the first plurality of gear projections 100 when the first gear 20 is in driving relation with the dog clutch 70 and, simultaneously, the leading face 101 of each of the first plurality of gear projections 100 is providing a driving force against the first face 201 of an associated one of the first plurality of clutch projections 200 to cause the dog clutch 70 and the propeller shaft 30 to rotate in synchrony with the first gear 20. The second face 202 of each of the first plurality of clutch projections 200 is disposable in contact relation with the trailing face 102 of an associated one of the first plurality of gear projections 100 when the dog clutch 70 is in driving relation with the first gear 20 and the second face 202 of each of the first plurality of clutch projections 200 is providing a driving force against the trailing face 102 of an associated one of the first plurality of gear projections 100 to cause the dog clutch 70 and the propeller shaft 30 to rotate in synchrony with the first gear 20.

In a particularly preferred embodiment of the present invention, the dog clutch 70 is attached to the propeller shaft 30 by a plurality of spline teeth 210. In a particularly preferred embodiment of the present invention, the first gear 20 is a forward gear which, when the first plurality of gear projections 100 is engaged in driving association with the first plurality of clutch projections 200, a propeller 50 of the marine propulsion rotates in a direction which exerts a force on an associated marine vessel in a forward direction. The first and second gears, 20 and 22, are bevel gears in a preferred embodiment of the present invention. Similarly, the drive gear 18 is also a bevel gear in a particularly preferred embodiment of the present invention.

Although the present invention has been described in particular detail and illustrated to show a preferred embodiment, it should be understood that alternative embodiments are also within its scope.

We claim:

1. A transmission for a marine propulsion device, comprising:

a propeller shaft supported for rotation about a propeller shaft axis;

a first gear disposed for rotation about said propeller shaft axis;

a second gear disposed for rotation about said propeller shaft axis;

a driveshaft supported for rotation about a driveshaft axis, said driveshaft axis being generally perpendicular to said propeller shaft axis;

a drive gear attached for rotation with said driveshaft, said first and second gears being disposed in meshing relation with said drive gear for rotation in opposite directions from each other about said propeller shaft;

a dog clutch attached for rotation with said propeller shaft about said propeller shaft axis and between said first and second gears, said dog clutch being movable parallel to said propeller shaft axis in a first direction toward said first gear and away from said second gear and in a second direction toward said second gear and away from said first gear;

a first plurality of clutch projections extending from said dog clutch in a direction toward said first gear; and a first plurality of gear projections extending from said first gear in a direction toward said dog clutch, each of said first plurality of gear projections having a leading face and a trailing face, said leading face and said trailing face each being disposed at a rake angle which is greater than one degree.

2. The transmission of claim 1, wherein:

said leading face and said trailing face are each disposed at a rake angle which is greater than three degrees.

3. The transmission of claim 1, wherein:

said leading face and said trailing face are each disposed at a rake angle which is generally equal to five degrees.

4. The transmission of claim 1, further comprising:

a second plurality of gear projections extending from said second gear in a direction toward said dog clutch, each of said second plurality of gear projections having a leading face and a trailing face, said leading face being disposed at a rake angle which is greater than one degree and said trailing face being disposed at a rake angle which is generally equal to zero degrees.

5. The transmission of claim 1, wherein:

each of said first plurality of clutch projections has a first face and a second face, said first face and said second face each being disposed at a rake angle which is greater than one degree.

6. The transmission of claim 5, wherein:

said first face of each of said first plurality of clutch projections is disposable in contact relation with said leading face of an associated one of said first plurality of gear projections when said first gear is in driving relation with said dog clutch and said leading face of each of said first plurality of gear projections is providing a driving force against said first face of an associated one of said first plurality of clutch projections to cause said dog clutch and said propeller shaft to rotate in synchrony with said first gear.

7. The transmission of claim 5, wherein:

said second face of each of said first plurality of clutch projections is disposable in contact relation with said trailing face of an associated one of said first plurality of gear projections when said dog clutch is in driving relation with said first gear and said second face of each of said first plurality of clutch projections is providing a driving force against said trailing face of an associated one of said first plurality of gear projections to cause said dog clutch and said propeller shaft to rotate in synchrony with said first gear.

8. The transmission of claim 1, wherein:

said dog clutch is attached to said propeller shaft by a plurality of spline teeth.

9. The transmission of claim 1, wherein:

said first gear is a forward gear which, when said first plurality of gear projections is engaged in driving association with said first plurality of clutch projections, a propeller of said marine propulsion system rotates in a direction which exerts a force on an associated marine vessel in a forward direction.

10. The transmission of claim 1, wherein:

said first and second gears are both bevel gears.

11. The transmission of claim 10, wherein:

said drive gear is a bevel gear.

12. A transmission for a marine propulsion device, comprising:

a propeller shaft supported for rotation about a propeller shaft axis;

a first gear disposed for rotation about said propeller shaft axis;

a second gear disposed for rotation about said propeller shaft axis, said first and second gears both being bevel gears;

a driveshaft supported for rotation about a driveshaft axis, said driveshaft axis being generally perpendicular to said propeller shaft axis;

a drive gear attached for rotation with said driveshaft, said first and second gears being disposed in meshing relation with said drive gear for rotation in opposite directions from each other about said propeller shaft;

a dog clutch attached for rotation with said propeller shaft about said propeller shaft axis and between said first and second gears, said dog clutch being movable parallel to said propeller shaft axis in a first direction toward said first gear and away from said second gear and in a second direction toward said second gear and away from said first gear, said dog clutch being attached to said propeller shaft by a plurality of spline teeth;

a first plurality of clutch projections extending from said dog clutch in a direction toward said first gear, each of said first plurality of clutch projections having a first face and a second face, said first face and said second face each being disposed at a rake angle which is greater than one degree; and a first plurality of gear projections extending from said first gear in a direction toward said dog clutch, each of said first plurality of gear projections having a leading face and a trailing face, said leading face and said trailing face each being disposed at a rake angle which is greater than one degree.

13. The transmission of claim 12, wherein:

said first face of each of said first plurality of clutch projections is disposable in contact relation with said leading face of an associated one of said first plurality of gear projections when said first gear is in driving relation with said dog clutch and said leading face of each of said first plurality of gear projections is providing a driving force against said first face of an associated one of said first plurality of clutch projections to cause said dog clutch and said propeller shaft to rotate in synchrony with said first gear.

14. The transmission of claim 13, wherein:

said second face of each of said first plurality of clutch projections is disposable in contact relation with said trailing face of an associated one of said first plurality of gear projections when said dog clutch is in driving relation with said first gear and said second face of each of said first plurality of clutch projections is providing a driving force against said trailing face of an associated one of said first plurality of gear projections to cause said dog clutch and said propeller shaft to rotate in synchrony with said first gear.

15. The transmission of claim 14, wherein:

said leading face and said trailing face are each disposed at a rake angle which is generally equal to five degrees.

16. The transmission of claim 15, further comprising:

a second plurality of gear projections extending from said second gear in a direction toward said dog clutch, each of said second plurality of gear projections having a leading face and a trailing face, said leading face being disposed at a rake angle which is greater than one degree and said trailing face being disposed at a rake angle which is generally equal to zero degrees.

17. The transmission of claim 16, wherein:

said first gear is a forward gear which, when said first plurality of gear projections is engaged in driving association with said first plurality of clutch projections, a propeller of said marine propulsion system rotates in a direction which exerts a force on an associated marine vessel in a forward direction.

18. A transmission for a marine propulsion device, comprising:

a propeller shaft supported for rotation about a propeller shaft axis;

a first gear disposed for rotation about said propeller shaft axis;

a second gear disposed for rotation about said propeller shaft axis;

a driveshaft supported for rotation about a driveshaft axis, said driveshaft axis being generally perpendicular to said propeller shaft axis;

a drive gear attached for rotation with said driveshaft, said first and second gears being disposed in meshing relation with said drive gear for rotation in opposite directions from each other about said propeller shaft;

a dog clutch attached for rotation with said propeller shaft about said propeller shaft axis and between said first and second gears, said dog clutch being movable parallel to said propeller shaft axis in a first direction toward said first gear and away from said second gear and in a second direction toward said second gear and away from said first gear;

a first plurality of clutch projections extending from said dog clutch in a direction toward said first gear, each of said first plurality of clutch projections having a first face and a second face, said first face and said second face each being disposed at a rake angle which is greater than one degree; and a first plurality of gear projections extending from said first gear in a direction toward said dog clutch, each of said first plurality of gear projections having a leading face and a trailing face, said leading face and said trailing face each being disposed at a rake angle which is greater than one degree, said first gear being a forward gear which, when said first plurality of gear projections is engaged in driving association with said first plurality of clutch projections, a propeller of said marine propulsion system rotates in a direction which exerts a force on an associated marine vessel in a forward direction, said second face of each of said first plurality of clutch projections being disposable in contact relation with said trailing face of an associated one of said first plurality of gear projections when said dog clutch is in driving relation with said first gear and said second face of each of said first plurality of clutch projections is providing a driving force against said trailing face of an associated one of said first plurality of gear projections to cause said dog clutch and said propeller shaft to rotate in synchrony with said first gear.

19. The transmission of claim 18, further comprising:

a second plurality of gear projections extending from said second gear in a direction toward said dog clutch, each of said second plurality of gear projections having a leading face and a trailing face, said leading face and said trailing face each being disposed at a rake angle which is generally equal to five degrees.

20. The transmission of claim 19, wherein:

said first face of each of said first plurality of clutch projections is disposable in contact relation with said leading face of an associated one of said first plurality of gear projections when said first gear is in driving relation with said dog clutch and said leading face of each of said first plurality of gear projections is providing a driving force against said first face of an associated one of said first plurality of clutch projections to cause said dog clutch and said propeller shaft to rotate in synchrony with said first gear, said dog clutch being attached to said propeller shaft by a plurality of spline teeth, said first and second gears being bevel gears.

* * * * *